US009963643B2

(12) United States Patent
Merdrignac et al.

(10) Patent No.: US 9,963,643 B2
(45) **Date of Patent: *May 8, 2018**

(54) PROCESS FOR REFINING A HEAVY HYDROCARBON FEED USING A SELECTIVE DEASPHALTING STEP

(71) Applicant: IFP Energies nouvelles, Rueil-Malmaison (FR)

(72) Inventors: Isabelle Merdrignac, Chaponnay (FR); Jerome Majcher, Lyons (FR); Mathieu Digne, Lyons (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/652,813

(22) PCT Filed: Dec. 3, 2013

(86) PCT No.: PCT/FR2013/052923

§ 371 (c)(1),
(2) Date: Jun. 17, 2015

(87) PCT Pub. No.: WO2014/096602

PCT Pub. Date: Jun. 26, 2014

(65) Prior Publication Data

US 2015/0337223 A1 Nov. 26, 2015

(30) Foreign Application Priority Data

Dec. 18, 2012 (FR) ..... 12/03471

(51) Int. Cl.

| | |
|---|---|
| ***C10G 67/04*** | (2006.01) |
| ***C10G 21/14*** | (2006.01) |
| ***C10G 67/14*** | (2006.01) |
| ***C10G 69/04*** | (2006.01) |
| ***C10G 21/00*** | (2006.01) |
| ***C10G 21/06*** | (2006.01) |

(52) U.S. Cl.

CPC ..... *C10G 21/14* (2013.01); *C10G 21/003* (2013.01); *C10G 21/06* (2013.01); *C10G 67/0463* (2013.01); *C10G 67/14* (2013.01); *C10G 69/04* (2013.01); *C10G 2300/44* (2013.01)

(58) Field of Classification Search

CPC ..... C10G 67/0454; C10G 67/0463; C10G 67/0472; C10G 67/0481; C10G 67/049; C10G 21/003

See application file for complete search history.

(56) References Cited

U.S. PATENT DOCUMENTS

| | | | | | |
|---|---|---|---|---|---|
| 3,287,254 | A * | 11/1966 | Paterson | C10G 21/003 | 208/309 |
| 4,278,529 | A * | 7/1981 | Gearhart | C10G 1/045 | 208/309 |
| 4,305,812 | A | 12/1981 | Shih et al. | | |
| 4,450,067 | A | 5/1984 | Angevine et al. | | |
| 4,455,216 | A | 6/1984 | Angevine et al. | | |
| 4,493,765 | A * | 1/1985 | Long | C10G 21/003 | 208/309 |
| 5,092,983 | A * | 3/1992 | Eppig | B01D 11/02 | 208/13 |
| 8,784,646 | B2 | 7/2014 | Sanchez et al. | | |
| 2012/0061292 | A1 | 3/2012 | Sanchez et al. | | |
| 2013/0081976 | A1 | 4/2013 | Heraud et al. | | |

FOREIGN PATENT DOCUMENTS

| | | | |
|---|---|---|---|
| FR | 2958656 | A1 | 10/2011 |
| FR | 2964388 | A1 | 3/2012 |
| GB | 708051 | A | 4/1954 |

OTHER PUBLICATIONS

International Search Report dated Feb. 20, 2014 issued in corresponding PCT/FR2013/052923 application (pp. 1-6).

* cited by examiner

*Primary Examiner* — Michelle Stein

(74) *Attorney, Agent, or Firm* — Millen White Zelano & Branigan, PC

(57) ABSTRACT

The invention concerns a process for refining a heavy hydrocarbon feed, comprising the following steps:

a) a step for selective deasphalting of the heavy hydrocarbon feed by single-step liquid/liquid extraction in an extraction medium, said extraction being carried out using a mixture of at least one polar solvent and at least one apolar solvent, in order to obtain an asphalt phase and a deasphalted oil phase DAO, the proportions of said polar solvent and said apolar solvent in the solvent mixture being adjusted as a function of the properties of the feed and the desired asphalt yield, said deasphalting step being carried out under subcritical conditions for the solvent mixture;

b) a step for hydrotreatment of at least a portion of the deasphalted oil phase DAO obtained from step a);

c) optionally, a step for catalytic cracking of at least a portion of the effluent obtained from step b).

12 Claims, No Drawings

PROCESS FOR REFINING A HEAVY HYDROCARBON FEED USING A SELECTIVE DEASPHALTING STEP

FIELD OF THE INVENTION

The present invention relates to a novel process for refining a heavy hydrocarbon feed, in particular obtained from atmospheric distillation or vacuum distillation of crude oil.

A number of layouts for upgrading such feeds are possible in the refinery, depending on the desired products, the nature of the crude oil being processed, economic constraints, etc. In such layouts, using a catalytic hydrotreatment means that, by bringing a hydrocarbon feed into contact with a catalyst and in the presence of hydrogen, its content as regards asphaltenes, metals, sulphur and other impurities can be substantially reduced while its hydrogen to carbon (H/C) ratio can be improved, by transforming it at least in part into lighter cuts.

Of the various types of hydrotreatment, fixed bed residue hydrotreatment (routinely known as a Resid Desulphurization Unit, RDS) is an industry-wide process in terms of technology. In such a process, the feed, mixed with hydrogen, moves through several fixed bed reactors disposed in series and filled with catalysts, the first reactor or reactors being used to carry out primarily hydrodemetallization of the feed (the step known as HDM) therein as well as some of the hydrodesulphurization (the step known as HDS), the final reactor or reactors being used to carry out intense refining of the feed therein, in particular hydrodesulphurization. The total pressure is typically in the range 10 to 20 MPa and the temperatures are in the range 340° C. to 420° C.

Fixed bed hydrotreatment processes perform well in refining starting from a feed containing up to 5% by weight of sulphur and up to 150 to 250 ppm of metals, in particular nickel and vanadium: as an example, this process can be used to produce mostly a heavy cut (370° C.+) with less than 0.5% by weight of sulphur and containing less than 20 ppm of metals. This cut which is obtained may act as a base for the production of good quality fuels, in particular when a low sulphur content is required, or for the production of good quality feeds for other units such as catalytic cracking. The concatenation of a RDS unit with a residue fluidized bed catalytic cracking unit (RFCC) with the aim of producing mainly gasolines or propylene is particularly sought-after, since the low metals content and Conradson Carbon Residue (also termed CCR) of the heavy cut leaving the RDS unit means that the use of the RFCC unit is optimized, in particular by the terms of unit operating costs. The Conradson Carbon Residue is defined in ASTM standard D 482 and represents to the skilled person a well-known evaluation of the quantity of carbon residues produced after combustion under standard temperature and pressure conditions.

However, RDS units suffer from at least two major disadvantages: on the one hand, the residence times to obtain the required specifications on the effluents are very long (typically 3 to 7 hours), which means that large units are required. On the other hand, the cycle times (time after which the performance of the unit can no longer be maintained because the catalysts have been deactivated and/or plugged) are relatively short compared with processes for the hydrotreatment of lighter cuts. This gives rise to stoppages of the unit and replacement of all or a part of the spent catalysts using new catalysts. Reducing the size of RDS units as well as increasing the cycle time is thus of major industrial importance.

One known prior art solution consists of producing a concatenation of a conventional deasphalting unit (hereinafter termed conventional or classical SDA) and a RDS unit. The principle of deasphalting is based on a separation by precipitation of an oil resin into two phases: i) a phase termed the "deasphalted oil", also known as the "oil matrix" or "oil phase" or DAO (deasphalted oil); and ii) a phase termed the "asphalt" or occasionally "pitch" containing molecular structures, inter alia, which are refractory to the subsequent steps in the refining process. Because of its mediocre quality, the asphalt is a problematic product for refining operations, in particular as regards the performance of the catalysts for the RDS unit, which should be minimized.

Thus, patent application US 2004/0069685 A1 describes a refining layout based on a concatenation of a step for distilling a feed to produce a distillate M1 and a residue M2; a step for hydrogenation and desulphurization of distillate M1 to produce an effluent M3; furthermore, a step for deasphalting residue M2 with a solvent to produce a deasphalted oil, DAO, M4 and an asphalt residue M5; a step for hydrodemetallization/hydrodesulphurization of at least a portion of the deasphalted oil DAO M4 in order to obtain a refined oil M6; and a step for combining the effluent M3 and refined oil M6. The step for deasphalting the residue M2 described in US 2004/0069685 A1 is carried out with a paraffinic type solvent.

U.S. Pat. No. 4,305,812 and U.S. Pat. No. 4,455,216 describe deasphalting in the form of a counter-current extraction in a column with a plurality of solvents of increasing polarity injected at different heights of the column.

All of the proposed prior art solutions are based on conventional deasphalting the principle of which comes up against limitations in terms of yield and flexibility compared with the upgrading envisaged for oil residues. The use of paraffinic type solvents or solvent mixtures in conventional deasphalting suffers in particular from a limitation in the yield of deasphalted oil DAO, said yield increasing with the molecular weight of the solvent (up to C6/C7 solvent) then flattening out to a threshold which is a function of each feed and each solvent.

The Applicant's research has led to the development of a novel refining process which can overcome the disadvantages cited above, in particular those concerning the size of the RDS units and the catalytic cycle time for the RDS unit, by carrying out a selective deasphalting step, known as selective SDA, upstream of said RDS unit in the refining process. It has been shown that carrying out such deasphalting means that the asphalt fraction known as the ultimate fraction, i.e. specifically containing structures which are refractory to the subsequent steps of the process for refining the feed and for obtaining a deasphalted oil, DAO, yield can be obtained which can go beyond the threshold of dependency on the solvent cited above.

AIM OF THE INVENTION

The present invention concerns a process for refining a heavy hydrocarbon feed, comprising the following steps:

a) a step for selective deasphalting of the heavy hydrocarbon feed by single-step liquid/liquid extraction in an extraction medium, said extraction being carried out using a mixture of at least one polar solvent and at least one apolar solvent, in order to obtain an asphalt phase and a deasphalted oil phase DAO, the proportions of said polar solvent and said apolar solvent in the solvent mixture being adjusted as a function of the properties of the feed and the desired asphalt yield, said deasphalting step being carried out under subcritical conditions for the solvent mixture;

b) a step for hydrotreatment of at least a portion of the deasphalted oil phase DAO obtained from step a) in the presence of hydrogen in at least one fixed bed reactor containing at least one hydrodemetallization catalyst under conditions which can be used to obtain an effluent with a reduced metals content and Conradson Carbon Residue;

c) optionally, a step for catalytic cracking of at least a portion of the effluent obtained from step b) in at least one fluidized bed reactor under conditions for producing a gaseous fraction, a gasoline fraction, a LCO fraction, a HCO fraction and slurry.

Advantageously, in accordance with the invention, the polar solvent used is selected from pure aromatic or naphtheno-aromatic solvents, polar solvents comprising heteroelements, or a mixture thereof or cuts, which are rich in aromatics such as cuts obtained from FCC (fluid catalytic cracking), and cuts derived from coal, from biomass or from a biomass/coal mixture.

Advantageously, in accordance with the invention, the apolar solvent used comprises a solvent composed of a saturated hydrocarbon containing 2 or more, preferably in the range 2 to 9, carbon atoms.

Advantageously, in accordance with the invention, the volume ratio of the mixture of polar and apolar solvents to the mass of feed is in the range 1/1 to 10/1, expressed in liters per kilogram.

Advantageously, in accordance with the invention, the feed is a heavy feed obtained from atmospheric distillation or from vacuum distillation of crude oil, typically having boiling points of at least 300° C. and containing impurities, in particular sulphur, nitrogen and metals, or a residual fraction obtained from direct liquefaction of coal or a H-Coal™ vacuum distillate or a residual fraction obtained from the direct liquefaction of lignocellulosic biomass, alone or as a mixture with coal and/or a residual oil fraction.

Advantageously in accordance with the invention, step b) is carried out with at least one catalyst carrying out principally hydrodesulphurization under conditions that can produce a liquid effluent with a reduced metals, Conradson Carbon Residue and sulphur content.

Advantageously in accordance with the invention, step b) is carried out at a pressure in the range 2 to 35 MPa, a temperature in the range 300° C. to 500° C. and an hourly space velocity in the range 0.1 to 5 $h^{-1}$.

Advantageously in accordance with the invention, the effluent obtained from step b) undergoes a separation step c) in order to separate at least:

a gaseous cut;
a gasoline cut;
a gas oil cut;
a vacuum distillate cut;
a vacuum residue cut.

Advantageously in accordance with the invention, when step c) is carried out, it is carried out on at least one mixture comprising at least one vacuum distillate cut and/or a vacuum residue cut.

DETAILED DESCRIPTION OF THE INVENTION

The Feed

The heavy hydrocarbon feed in accordance with the process of the invention is advantageously a heavy feed obtained from atmospheric distillation or vacuum distillation of crude oil, typically with boiling points of at least 300° C. and containing impurities, in particular sulphur, nitrogen and metals.

The feed for the process of the invention may be of petroleum origin of the atmospheric residue or vacuum residue type obtained from crude known as conventional crude (API degree>20°), heavy crude (API degree in the range 10 to 20°) or extra heavy crude (API degree<10°).

Said feed may also be a residual fraction obtained from direct liquefaction of coal (atmospheric residue or vacuum residue obtained, for example, from the H-Coal™ process), or a H-Coal™ vacuum distillate or indeed a residual fraction obtained from the direct liquefaction of lignocellulosic biomass, alone or as a mixture with coal, and/or a residual oil fraction.

Selective Deasphalting Step a)

In the remainder of the text and also above, the expression "mixture of solvent in accordance with the invention" is intended to mean a mixture of at least one polar solvents and at least one apolar solvent in accordance with the invention.

In accordance with the process of the invention, the heavy hydrocarbon feed undergoes a step a) for selective deasphalting carried out in a single step. Said selective deasphalting step a) comprises bringing said feed into contact with a mixture of at least one polar solvent and at least one apolar solvent in an extraction medium. The proportions of polar solvent and apolar solvent are adjusted as a function of the properties of the feed and the desired level of asphalt extraction.

The step a) for selective deasphalting provides for great progress in maintaining all or a portion of the molecular structures known as refractory structures in solution in the DAO oil matrix. It provides for great progress in maintaining all or a portion of the polar structures of heavy resins and asphaltenes in solution in the DAO oil matrix; these are the principal constituents of the asphalt phase. The selective deasphalting step a) can thus be used to select which type of polar structures remain dissolved in the DAO oil matrix. As a consequence, selective deasphalting step a) can be used to selectively extract, from the feed, only a portion of that asphalt, i.e. the most polar structures and the most refractory structures in the refining processes.

The asphalt extracted using the process of the invention, corresponding to ultimate asphalt, is essentially composed of refractory polyaromatic and/or heteroatomic molecular structures. The asphalt yield is correlated with the DAO oil yield by the following relationship:

$$\text{Asphalt yield} = 100 - [\text{DAO oil yield}]$$

Selective deasphalting step a) may be carried out in an extraction column, preferably in a mixer-settler. This step is carried out by liquid/liquid extraction in a single step.

The liquid/liquid extraction of step a) is carried out under subcritical conditions for the solvent mixture, i.e. at a temperature below the critical temperature of the solvent mixture. The extraction temperature is advantageously in the range 50° C. to 350° C., preferably in the range 90° C. to 320° C., more preferably in the range 100° C. to 310° C., more preferably in the range 120° C. to 310° C. and more preferably in the range 150° C. to 310° C. and the pressure is advantageously in the range 0.1 to 6 MPa.

The volume ratio of the mixture of solvents of the invention (volume of polar solvent+volume of apolar solvent) to the mass of the feed is generally in the range 1/1 to 10/1, preferably in the range 2/1 to 8/1, expressed in liters per kilogram.

The mixture of solvents of the invention used in step a) is a mixture of at least one polar solvent and at least one apolar solvent.

The polar solvent used may be selected from pure or naphtheno-aromatic solvents, polar solvents comprising hetero-elements, or a mixture thereof. The aromatic solvent is advantageously selected from monoaromatic hydrocarbons, preferably benzene, toluene or xylenes, used alone or as a mixture; diaromatics or polyaromatics; aromatic naphtheno-hydrocarbon hydrocarbons such as tetraline or indane; heteroaromatic aromatic hydrocarbons (oxygen-containing, nitrogen-containing, sulphur-containing) or any other family of compounds presenting a more polar nature than the saturated hydrocarbons such as, for example, dimethylsulphoxide (DMSO), dimethylformamide (DMF), tetrahydrofuran (THF). The polar solvent used in the process of the invention may also be a cut which is rich in aromatics. The aromatic-rich cuts of the invention may, for example, be cuts obtained from FCC (fluid catalytic cracking) such as heavy gasoline or LCO (light cycle oil). Cuts derived from coal, from biomass or from a biomass/coal mixture, possibly with a residual oil feed after thermochemical conversion with or without hydrogen, with or without a catalyst, may also be cited. Preferably, the polar solvent used is a monoaromatic hydrocarbon used pure or as a mixture with another aromatic hydrocarbon.

The apolar solvent used is preferably a solvent composed of saturated hydrocarbon, said saturated hydrocarbon containing 2 or more, preferably in the range 2 to 9, carbon atoms. These saturated hydrocarbon solvents are used pure or as a mixture (for example: mixture of alkanes and/or cycloalkanes, or indeed light naphtha type oil cuts).

Advantageously, the boiling point of the polar solvent of the solvent mixture of the invention is higher than the boiling point of the apolar solvent.

Combined with the temperature and pressure conditions for the extraction of the invention, varying the proportions of the polar solvent(s) and apolar solvent(s) constitutes a genuine key to regulating the selective deasphalting step a) of the invention. As an example, for a given feed, the higher the proportion and/or the intrinsic polarity of the polar solvent in the solvent mixture, the higher the yield of deasphalted oil, a portion of the polar structures of the feed remaining dissolved and/or dispersed in the deasphalted oil phase DAO. The reduction in the proportion of polar solvent in the mixture has the effect of increasing the quantity of asphaltene phase recovered. Thus, the selective deasphalting step a) of the invention can be used to selectively extract, whatever the feed, an asphalt fraction termed the ultimate fraction, enriched in impurities and in refractory compounds, while leaving in solution in the oil matrix at least a portion of the polar structures of the heavy resins and the least polar asphaltenes which are not refractory to the subsequent steps in the refining process.

Advantageously, the proportion of polar solvent in the mixture of polar solvent and apolar solvent is in the range 0.1% to 99.9%, preferably in the range 0.1% to 95%, preferably in the range 1% to 95%, preferably in the range 1% to 90%, preferably in the range 1% to 85% and more preferably in the range 1% to 80%.

The percentage of polar solvent in the mixture of polar and apolar solvents is a function of the nature of the feed, the molecular structures composing a feed varying from one feed to another. Not all feeds have the same refractory nature. The quantity of asphalt to be extracted is not necessarily the same; it depends on the nature of the feed.

The nature of the feed also depends on its origin: oil, coal or biomass in type.

The selective deasphalting step a) has the advantage of providing for a considerable improvement in the yield of deasphalted oil DAO over a whole range which until now has not been explored in conventional deasphalting. For a given feed for which the DAO oil yield obtained flattens out at 75% (extraction with normal heptane), by adjusting the proportion of polar solvent and apolar solvent, selective deasphalting can be used to cover the 75-99.9% range of yield of deasphalted oil DAO.

Whatever the feed, the yield of deasphalted oil DAO obtained from step a) is advantageously in the range 50% to 99.9%, preferably in the range 75% to 99.9%, more preferably in the range 80% to 99.9%.

Carrying out step a) has the advantage of improving the initial feed properties by obtaining a deasphalted oil with a lower sulphur content, containing less metal and having a lower Conradson Carbon Residue (CCR), which means that treatment during steps b) and c) of the refining process of the invention is easier or the performance is better.

Step b) for Hydrotreatment of the Oil Phase DAO

Step b) for hydrotreatment of at least a portion of the oil phase DAO obtained from step a) is carried out under fixed bed hydrotreatment conditions. Step b) is carried out under conditions which are known to the skilled person.

In accordance with the invention, step b) is carried out at a pressure in the range 2 to 35 MPa and at a temperature in the range 300° C. to 500° C. and an hourly space velocity in the range 0.1 to 5 $h^{-1}$; preferably at a pressure in the range 10 to 20 MPa and a temperature in the range 340° C. to 420° C. and an hourly space velocity in the range 0.1 to 2 $h^{-1}$.

The term "hydrotreatment" (HDT) in particular means hydrodesulphurization reactions (HDS), hydrodemetallization reactions (HDM), accompanied by hydrogenation, hydrodeoxygenation, hydrodenitro genation, hydrodearomatization, hydroisomerization, hydrodealkylation, hydrocracking, hydrodeasphalting and Conradson Carbon Residue reduction.

In a preferred variation, the hydrotreatment step comprises a first hydrodemetallization step comprising one or more fixed bed hydrodemetallization zones optionally preceded by at least two hydrotreatment guard zones and a subsequent second hydrodesulphurization step comprising one or more fixed bed hydrodesulphurization zones in which, during the first step known as hydrodemetallization, the feed and hydrogen are passed over a hydrodemetallization catalyst under hydrodemetallization conditions then during the second, subsequent, step the effluent from the first step is passed over a hydrodesulphurization catalyst under hydrodesulphurization conditions. This process, which is known by the name HYVAHL-F™, is described in U.S. Pat. No. 5,417,846.

The skilled person will readily understand that in the hydrodemetallization step, hydrodemetallization reactions are primarily carried out, but some hydrodesulphurization reactions may occur at the same time. Similarly, in the hydrodesulphurization step, primarily hydrodesulphurization reactions are carried out, but some hydrodemetallization reactions may occur at the same time.

In a preferred variation of the invention, step a) is carried out in one or more fixed bed hydrodesulphurization zones.

The hydrotreatment catalysts used are preferably known catalysts and are generally granular catalysts comprising, on a support, at least one metal or metallic compound with a hydrodehydrogenating function. These catalysts are advantageously catalysts comprising at least one metal from group VIII, generally selected from the group formed by nickel and/or cobalt and/or at least one metal from group VIB, preferably molybdenum and/or tungsten. As an example, the catalyst used comprises 0.5% to 10% by weight of nickel, preferably 1% to 5% by weight of nickel (expressed as nickel oxide, NiO) and 1% to 30% by weight of molybdenum, preferably 5% to 20% by weight of molybdenum (expressed as molybdenum oxide, $MoO_3$) on a mineral support. This support could, for example, be selected from the group formed by alumina, silica, silica-aluminas, magnesia, clays and mixtures of at least two of these minerals. Advantageously, this support comprises other doping compounds, in particular oxides selected from the group formed by boron oxide, zirconia, cerine, titanium oxide, phosphoric anhydride and a mixture of these oxides. Usually, an alumina support is used, and most frequently an alumina support doped with phosphorus and optionally boron. When phosphoric anhydride $P_2O_5$ is present, its concentration is less than 10% by weight. When boron trioxide $B_2O_5$ is present, its concentration is less than 10% by weight. The alumina used is normally a $\gamma$ or $\eta$ alumina. This catalyst is usually used in the form of extrudates. The total quantity of oxides of metals from groups VIB and VIII is usually 5% to 40% by weight, in general 7% to 30%, by weight and the weight ratio, expressed as the metal oxide, between the metal (or metals) from group VIB and the metal (or metals) from group VIII is generally 20 to 1, usually 10 to 2.

In the case of a hydrotreatment step including a hydrodemetallization step (HDM), then a hydrodesulphurization step (HDS), specific catalysts adapted to each step are usually employed. Examples of catalysts which may be used in the HDM step are indicated in patents EP 0 113 297, EP 0 113 284, U.S. Pat. No. 5,221,656, U.S. Pat. No. 5,827,421, U.S. Pat. No. 7,119,045, U.S. Pat. No. 5,622,616 and U.S. Pat. No. 5,089,463. Preferably, HDM catalysts are used in swing reactors. Examples of catalysts which may be used in the HDS step are indicated in patents EP 0 113 297, EP 0 113 284, U.S. Pat. No. 6,589,908, U.S. Pat. No. 4,818,743 or U.S. Pat. No. 6,332,976. It is also possible to use a mixed catalyst which is active in both HDM and HDS, both in the HDM section and in the HDS section, as described in patent FR 2 940 143. Prior to injecting the feed, the catalysts used in the process of the present invention preferably undergo a sulphurization treatment (in situ or ex situ).

Step for Separation of the Effluent Obtained from Step b)

Advantageously, in accordance with the invention, the products obtained during step b) undergo a separation step from which the following are advantageously recovered:

a gaseous cut;

a gasoline cut with a boiling point in the range 20° C. to 150° C.;

a gas oil cut with a boiling point in the range 150° C. to 375° C.;

a vacuum distillate (vacuum gas oil, VGO);

a vacuum residue (VR).

Catalytic Cracking Step c)

Advantageously, the refining process of the invention comprises a step for catalytic cracking carried out on a mixture comprising at least one vacuum distillate cut (VGO) and/or a vacuum residue cut (VR) obtained from step b). Advantageously, said cuts are obtained from a previous separation step following step b).

Step c) is carried out under conventional catalytic cracking conditions which are well known to the skilled person, in at least one fluidized bed reactor, so as to produce a gaseous fraction, a gasoline fraction, a LCO fraction, a HCO fraction and slurry.

This step may be carried out in a conventional manner known to the skilled person under conditions suitable for cracking residue with a view to producing hydrocarbon products with a lower molecular weight. Descriptions of the function and catalysts which may be used in the context of fluidized bed cracking in this step have been described, for example, in patent documents U.S. Pat. No. 4,695,370, EP-B-0 184 517, U.S. Pat. No. 4,959,334, EP-B-0 323 297, U.S. Pat. No. 4,965,232, U.S. Pat. No. 5,120,691, U.S. Pat. No. 5,344,554, U.S. Pat. No. 5,449,496, EP-A-0 485 259, U.S. Pat. No. 5,286,690, U.S. Pat. No. 5,324,696 and EP-A-0 699 224 the descriptions of which should be considered to be incorporated into the present invention.

As an example, a brief description of catalytic cracking (which was first used on an industrial scale in 1936) (HOUDRY process) or in 1942 in the case of a fluidized bed catalyst) can be found in ULLMANS ENCYCLOPEDIA OF INDUSTRIAL CHEMISTRY Volume A 18, 1991, pages 61 to 64. Normally, a conventional catalyst is used comprising a matrix, an optional additive and at least one zeolite. The quantity of zeolite can vary, but is normally approximately 3% to 60% by weight, often approximately 6% to 50% by weight and frequently approximately 10% to 45% by weight. The zeolite is normally dispersed in the matrix. The quantity of additive is normally approximately 0 to 30% by weight and usually approximately 0 to 20% by weight. The quantity of matrix represents the complement to 100% by weight. The additive is generally selected from the group formed by oxides of metals from group IIA of the periodic classification of the elements such as magnesium oxide or calcium oxide, for example, or rare earth oxides and titanates of metals from group IIA. The matrix is usually a silica, an alumina, a silica-alumina, a silica-magnesia, a clay or a mixture of two or more of these products. The zeolite which is most frequently used is Y zeolite. Cracking is carried out in a substantially vertical reactor either in riser mode or in dropper mode.

The choice of catalyst and the operating conditions are functions of the desired products which are dependent on the processed feed, as described, for example, in the article by M MARCILLY pages 990-991 published in the review by l'Institut Français du Pétrole, November-December 1975 pages 969-1006. Normally, the operating temperature is approximately 450° C. to approximately 600° C. and the residence time in the reactor is less than 1 minute, often approximately 0.1 to 50 seconds.

Catalytic cracking step c) is advantageously a step for fluidized bed catalytic cracking, for example using the R2R process developed by the Applicant. This step may be carried out in a conventional manner known to the skilled person under suitable residue cracking conditions with a view to producing hydrocarbon products with a lower molecular weight. Descriptions of the function and the catalysts which may be used in the context of fluidized bed catalytic cracking in this step c) are described, for example, in patent documents U.S. Pat. No. 4,695,370, EP-B-0 184 517, U.S. Pat. No. 4,959,334, EP-B-0 323 297, U.S. Pat. No. 4,965,232, U.S. Pat. No. 5,120,691, U.S. Pat. No. 5,344,554, U.S. Pat. No. 5,449,496, EP-A-0 485 259, U.S. Pat. No. 5,286,690, U.S. Pat. No. 5,324,696 and EP-A-0 699 224.

The fluidized bed catalytic cracking reactor may operate in riser or dropper mode. Although not a preferred embodiment of the present invention, it is also possible to carry out the catalytic cracking in a moving bed reactor.

Particularly preferred catalytic cracking catalysts are those which contain at least one zeolite, normally mixed with a suitable matrix such as alumina, silica, or silica-alumina, for example.

The process of the invention may have various advantages, namely:

- increasing the cycle time for the RDS hydrotreatment unit;
- reducing the capacity of units located downstream of the selective deasphalting unit of the invention due to evacuation of the ultimate asphalt fraction;
- obtaining better yields of high added value products (naphtha, LPG, etc.), better qualities for the products leaving the RFCC unit and a reduction in the catalytic cost for the RFCC catalytic cracking unit;
- reducing the proportion of hydrodemetallization catalyst HDM to the profit of the hydrodesulphurization catalyst HDS in the RDS hydrotreatment unit due to a reduction in the metals in the deasphalted oil DAO obtained from the selective deasphalting of the invention.

The following examples illustrate the invention without in any way limiting its scope.

EXAMPLES

The following examples were implemented with a feed A composed of 70% by weight of Arabian Medium atmospheric residue and 30% of Arabian Light vacuum residue.

TABLE 1

| Characteristics of feed A | |
|---|---|
| Density 15/4 | 0.991 |
| Sulphur (% by wt) | 3.79 |
| Conradson Carbon Residue (%) | 14 |
| C7 asphaltenes (% by wt) (NF standard T60-115) | 5 |
| Ni + V (ppm) | 100.3 |

Example 1 (Comparative): Use of a RDS Unit Alone

Example 1 corresponds to carrying out hydrotreatment of a feed A without prior pre-treatment in a fixed bed RDS unit alone, in the presence of hydrogen under the cycle start operating conditions indicated in Table 2.

TABLE 2

| Operating conditions for RDS unit, cycle start | |
|---|---|
| Catalyst | HF 858 - HM 848 - HT 438 |
| T (° C.) | 370 |
| Pressure (MPa) | 15 |
| HSV ($h^{-1}$) | 0.220 |
| $H_2$/feed ($Nm^3/m^3$ feed) | 1000 |

Commercial catalysts from Axens with the following trade names were used: HF 858, HM 848 and HT 438:

HF 858: catalyst primarily active in HDM;

HM 848: catalyst active in HDM and HDS;

HT 438: catalyst primarily active in HDS.

The yields (Yield, expressed as the percentage by weight), the sulphur content (S, expressed as the percentage by weight), the viscosity at 100° C. (CSt) and the Conradson Carbon Residue (CCR, expressed as the percentage by weight) of the cuts produced at the outlet from the RDS unit are given in Table 3.

TABLE 3

| Characteristics of cuts obtained from RDS unit | | | | | |
|---|---|---|---|---|---|
| Products | Yield (% by wt) | S (% by wt) | Viscosity at 100° C. (Cst) | CCR (% by wt) | Ni + V (ppm) |
| $NH_3$ | 0.22 | 0 | | | |
| $H_2S$ | 3.70 | 94.12 | | | |
| C1-C4 (gas) | 0.80 | 0 | | | |
| Gasoline (IP-150) | 1.46 | 0.01 | | | |
| Gas oil (150-375) | 14.61 | 0.02 | | | |
| VGO (375-520) | 35.66 | 0.11 | 7 | 0 | |
| VR (520+) | 44.95 | 0.59 | 165 | 10.5 | 29.3 |

The hydrogen consumption represented 1.40% of the weight of the feed.

Example 2 (Comparative): Use of a Conventional Deasphalting Unit Before the RDS Unit In Example 2, the same feed A, the same RDS unit and the same catalysts were used as in Example 1. A conventional deasphalting unit (conventional SDA) was added upstream of the RDS unit. The feed flow rate for feed A at the inlet to the conventional SDA was identical to that for the RDS unit of Example 1.

The operating conditions for the conventional deasphalting unit and the yields and characteristics of the deasphalted oil DAO obtained are indicated in Tables 4 and 5. The solvent used was butane.

TABLE 4

| Operating conditions for conventional SDA on feed A | |
|---|---|
| Ratio, butane/feed A (volume/mass) | 5/1 |
| Pressure (MPa) | 4 |
| Temperature (° C.) | 120 |

TABLE 5

| Yields and characteristics of deasphalted oil DAO obtained | |
|---|---|
| Yield, DAO (% by wt) | 65 |
| Density 15/4 | 0.953 |
| Sulphur (% by wt) | 3.1 |
| Conradson Carbon Residue (% by wt) | 4 |
| Ni + V (ppm) | 6 |

The fixed bed RDS unit was used on the deasphalted oil DAO obtained from the conventional deasphalting SDA, in the presence of hydrogen, under the cycle start operating conditions indicated in Table 6.

TABLE 6

| Operating conditions for RDS unit, cycle start | |
|---|---|
| Catalyst | HF 858 - HM 848 - HT 438 |
| Temperature (° C.) | 350 |
| Pressure (MPa) | 11 |
| HSV ($h^{-1}$) | 0.220 |
| $H_2$/feed ($Nm^3/m^3$ feed) | 1000 |

The same catalysts as those used in Example 1 were employed.

The RDS unit was used under operating conditions which produced outlet effluents in the same yield and with the same quality as those obtained in Example 1 using less severe operating conditions on the RDS unit.

The yields (Yield, expressed as the percentage by weight), the sulphur content (S, expressed as the percentage by weight), the viscosity at 100° C. (CSt) and the Conradson Carbon Residue (CCR, expressed as the percentage by weight) of the cuts produced at the outlet from the RDS unit are given in Table 6.

TABLE 6

Characteristics of cuts obtained from RDS unit

| Products | Yield (% by wt) | S (% by wt) | Viscosity 100° C. (Cst) | CCR (% by wt) | Ni + V (ppm) |
|---|---|---|---|---|---|
| $NH_3$ | 0.05 | 0 | | | |
| $H_2S$ | 3.17 | 94.12 | | | |
| C1-C4 | 0.80 | 0 | | | |
| Gasoline (IP-150) | 1.48 | 0.01 | | | |
| Gas oil (150-375) | 15.8 | 0.02 | | | |
| VGO (375-520) | 35.1 | 0.02 | 6 | 0 | |
| VR (520+) | 45.2 | 0.3 | 140 | 2.6 | 2.3 |

with the hydrogen consumed representing 1.60% of the weight of the feed.

It will be seen that the product yields are substantially identical to those obtained with the RDS unit (Example 1) for less severe operating conditions for the RDS unit (in terms of temperature and pressure). The quality of the products themselves was improved.

The performance of the RDS unit was maintained during the cycle by increasing the temperature up to a limiting temperature (typically 410° C.). This temperature increase could compensate for the loss of catalytic activity over time. Thus, a lower cycle start temperature meant that the cycle time could be increased (a gain of 5 months in a cycle compared with Example 1).

This concatenation produced good quality for the outlet products (sulphur, metals, CCR, etc.) as well as improved cycle times, however the loss of 35% from the inlet feed for the asphalt was too disadvantageous compared with the gains obtained.

Example 3 (in Accordance with the Invention): Selective Deasphalting+RDS

Example 3 corresponds to Example 2, with the only difference being that selective deasphalting in accordance with the invention (selective SDA step a)) was carried out upstream of the RDS unit, with an identical SDA inlet feed flow rate to that at the inlet to the RDS of Example 1. The RDS unit was operated under operating conditions which could provide outlet effluents with the same yield and quality as those obtained in Example 1, using less severe operating conditions on the RDS unit.

The selective SDA operating conditions of the invention and the characteristic yields for the deasphalted oil DAO obtained are indicated in Tables 7 and 8. A mixture of an apolar solvent (heptane) and a polar solvent (toluene) was used in a 97/3 volume ratio.

TABLE 7

Operating conditions for selective SDA on feed A

| | |
|---|---|
| Apolar/polar solvents ratio (v/v) | 97/3 |
| Solvents/feed ratio (v/w) | 5/1 |
| Pressure (MPa) | 2.5 |
| Temperature (° C.) | 240 |

TABLE 8

Yields and characteristics of deasphalted oil DAO obtained

| | |
|---|---|
| Yield DAO (% by wt) | 95 |
| Density 15/4 | 0.986 |
| Sulphur (% by wt) | 3.21 |
| Conradson Carbon Residue (%) | 13 |
| Ni + V (ppm) | 70 |

The fixed bed hydrotreatment unit RDS was operated using the deasphalted oil DAO obtained from selective SDA in the presence of hydrogen under the cycle start operating conditions indicated in Table 9.

TABLE 9

Operating conditions for RDS unit, cycle start

| | |
|---|---|
| Catalyst | HF 858 - HM 848 - HT 438 |
| Temperature (° C.) | 350 |
| Pressure (MPa) | 11 |
| HSV ($h^{-1}$) | 0.220 |
| $H_2$/feed ($Nm^3/m^3$ feed) | 1000 |

The same catalysts as those used in Example 1 were employed.

The RDS unit was operated under operating conditions for producing outlet effluents with the same yield and quality as those obtained in Example 1, using less severe operating conditions on the RDS unit.

The yields (Yield, expressed as the percentage by weight), the sulphur content (S, expressed as the percentage by weight), the viscosity at 100° C. (CSt) and the Conradson Carbon Residue (CCR, expressed as the percentage by weight) of the cuts produced at the outlet from the RDS unit are given in Table 10.

TABLE 10

Characteristics of cuts obtained from RDS unit

| Products | Yield (% by wt) | S (% by wt) | Viscosity 100° C. (Cst) | CCR (% by wt) | Ni + V (ppm) |
|---|---|---|---|---|---|
| $NH_3$ | 0.12 | 0 | | | |
| $H_2S$ | 3.09 | 94.12 | | | |
| C1-C4 | 0.78 | 0 | | | |
| Gasoline (IP-150) | 1.44 | 0.01 | | | |
| Gas oil (150-375) | 14.65 | 0.02 | | | |
| VGO (375-520) | 33.20 | 0.09 | 7 | 0 | |
| VR (520+) | 48.12 | 0.55 | 165 | 8.0 | 27.3 |

with the hydrogen consumed representing 1.40% of the weight of the feed.

It will be seen that the product yields and qualities were substantially identical to those obtained with the RDS unit alone, but the operating conditions for the RDS unit were less severe (in terms of temperature and pressure).

The performance of the RDS unit was maintained during the cycle by increasing the temperature up to a limiting temperature (typically 410° C.). This temperature increase could compensate for the loss of catalytic activity over time. Thus, a lower cycle start temperature meant that the cycle time could be increased (a gain of 5 months in a cycle compared with Example 1).

This concatenation provided better quality for the outlet products (sulphur, metals, CCR, etc.) than in Example 1 as well as improved cycle times, and because of the introduction of selective SDA, a drop in the quantity of asphalt which was much lower (5%) than in Example 2 (35%).

Example 4 (in Accordance with the Invention): Selective Deasphalting+RDS

Example 4 corresponded to Example 3, with the only difference being the operating conditions for the RDS unit which corresponded to those of Example 1. The intention was to evaluate the improvement in the quality of the effluents obtained from the RDS unit (and thus the quality of the feed for a downstream RFCC unit) induced by adding selective SDA upstream of the RDS unit.

The fixed bed RDS unit was operated on the deasphalted oil DAO obtained from selective SDA (characteristics of deasphalted oil, DAO, of Example 3) in the presence of hydrogen under the cycle start operating conditions indicated in Table 11.

TABLE 11

Operating conditions for RDS unit, start cycle

| | |
|---|---|
| Catalyst | HF 858 - HM 848 - HT 438 |
| T (° C.) | 370 |
| Pressure (MPa) | 15 |
| HSV ($h^{-1}$) | 0.220 |
| $H_2$/feed ($Nm^3/m^3$ feed) | 1000 |

The yields (Yield, expressed as the percentage by weight), the sulphur content (S, expressed as the percentage by weight), the viscosity at 100° C. (CSt) and the Conradson Carbon Residue (CCR, expressed as the percentage by weight) of the cuts produced at the outlet from the RDS unit are given in Table 12.

TABLE 12

Characteristics of cuts obtained from RDS unit

| Products | Yield (% by wt) | S (% by wt) | Viscosity 100° C. (Cst) | CCR (% by wt) | Ni + V (ppm) |
|---|---|---|---|---|---|
| $NH_3$ | 0.15 | 0 | | | |
| $H_2S$ | 3.24 | 94.12 | | | |
| C1-C4 | 0.81 | 0 | | | |
| Gasoline (IP-150) | 1.48 | 0.00 | | | |
| Gas oil (150-375) | 15.22 | 0.01 | | | |
| VGO (375-520) | 34.31 | 0.04 | 7 | 0 | |
| VR (520+) | 46.19 | 0.32 | 115 | 7.4 | 0 |

with the hydrogen consumed representing 1.40% of the weight of the feed.

It will be observed that, compared with Example 1, the sulphur contents and above all the Conradson Carbon Residue (CCR) and metals content of the vacuum residue fraction (VR) were significantly reduced, producing a feed for the RFCC which was of better quality.

The invention claimed is:

1. A process for refining a heavy hydrocarbon feed, comprising:

a) selectively deasphalting the heavy hydrocarbon feed by single-step liquid/liquid extraction in an extraction medium, said extraction being carried out using a solvent mixture of at least one polar solvent and at least one apolar solvent, in order to obtain an asphalt phase and a deasphalted oil phase, the proportions of said polar solvent and said apolar solvent in the solvent mixture being adjusted as a function of the properties of the feed and the desired asphalt yield, and said deasphalting is carried out under subcritical conditions for the solvent mixture;

b) hydrotreating at least a portion of the deasphalted oil phase obtained from a) in the presence of hydrogen in at least one fixed bed reactor containing at least one hydrodemetallization catalyst and under conditions which can be used to obtain an effluent with a reduced metals content and Conradson Carbon Residue; and c) optionally, catalytic cracking at least a portion of the effluent obtained from b) in at least one fluidized bed reactor under conditions for producing a gaseous fraction, a gasoline fraction, a LCO fraction, a HCO fraction and a slurry, wherein the extraction in a) is carried out at a temperature in the range of 150° C. to 310° C., and at a pressure in the range of 0.1 to 6 MPa, wherein the volume ratio of the mixture of polar and apolar solvents to the mass of feed is in the range 2/1 to 8/1, expressed in liters per kilogram, wherein said polar solvent is selected from monoaromatic hydrocarbons and mixtures thereof and said apolar solvent is selected from saturated hydrocarbons containing 2 to 9 carbon atoms, and the boiling point of said polar solvent is higher than said boiling point of the apolar solvent, and wherein the proportion of polar solvent in said solvent mixture is in the range of 1% to 80%.

2. A process according to claim 1, in which the feed is a heavy feed obtained from atmospheric distillation or from vacuum distillation of crude oil, a residual fraction obtained from direct liquefaction of coal, or a residual fraction obtained from the direct liquefaction of lignocellulosic biomass, alone or as a mixture with coal and/or a residual oil fraction.

3. A process according to claim 1, in which b) is carried out with at least one catalyst carrying out principally hydrodesulphurization under conditions that can produce a liquid effluent with a reduced metals content, reduced Conradson Carbon Residue content, and reduced sulfur content.

4. A process according to claim 1, in which b) is carried out at a pressure in the range of 2 to 35 MPa, a temperature in the range of 300° C. to 500° C., and an hourly space velocity in the range of 0.1 to 5 $h^{-1}$.

5. A process according to claim 1, in which the effluent obtained from b) undergoes a separation in order to separate at least:

a gaseous cut;

a gasoline cut;

a gas oil cut;

a vacuum distillate cut; or a vacuum residue cut.

6. A process according to claim 5, in which said separation is carried out on at least one mixture comprising at least one vacuum distillate cut and/or a vacuum residue cut.

7. A process according to claim 1, wherein catalytic cracking at least a portion of the effluent obtained from b) is performed in at least one fluidized bed reactor under conditions for producing a gaseous fraction, a gasoline fraction, a LCO fraction, a HCO fraction and a slurry.

8. A process according to claim 2, wherein the feed is a heavy feed, obtained from atmospheric distillation or from vacuum distillation of crude oil, having a boiling point of at least 300° C. and containing sulfur, nitrogen and metals impurities.

9. A process according to claim 4, wherein b) is carried out at a pressure in the range of 10 to 20 MPa, a temperature in the range of 340° C. to 420° C., and an hourly space velocity in the range of 0.1 to 2 $h^{-1}$.

10. A process according to claim 5, wherein the following are recovered from said separation:

a gaseous cut;

a gasoline cut with a boiling point in the range 20° C. to 150° C.;

a gas oil cut with a boiling point in the range 150° C. to 375° C.;

a vacuum distillate; and a vacuum residue.

11. A process according to claim 1, wherein said polar solvent is selected from benzene, toluene, xylenes, and mixtures thereof.

12. A process according to claim 1, wherein said solvent mixture is a mixture of heptane and toluene.

* * * * *